US011639564B1

(12) United States Patent
Marville

(10) Patent No.: US 11,639,564 B1
(45) Date of Patent: May 2, 2023

(54) TWISTED YARNS AND METHODS OF MANUFACTURE THEREOF

(71) Applicant: Wetsox, LLC, Staatsburg, NY (US)

(72) Inventor: Bryan Marville, Staatsburg, NY (US)

(73) Assignee: Wetsox, LLC, Staatsburg, NY (US)

( * ) Notice: Subject to any disclaimer, the term of this patent is extended or adjusted under 35 U.S.C. 154(b) by 0 days.

(21) Appl. No.: 17/866,412

(22) Filed: Jul. 15, 2022

(51) Int. Cl.

| | |
|---|---|
| ***D02G 3/04*** | (2006.01) |
| ***D02G 3/28*** | (2006.01) |
| ***D04B 1/26*** | (2006.01) |
| ***D04B 1/16*** | (2006.01) |
| ***D04B 21/20*** | (2006.01) |
| ***A41B 11/00*** | (2006.01) |
| *D02G 3/32* | (2006.01) |

(52) U.S. Cl.
CPC ..... *D02G 3/04* (2013.01); *A41B 11/00* (2013.01); *D02G 3/28* (2013.01); *D04B 1/16* (2013.01); *D04B 1/26* (2013.01); *D04B 21/207* (2013.01); *A41B 2500/10* (2013.01); *D02G 3/32* (2013.01); *D10B 2211/02* (2013.01); *D10B 2321/022* (2013.01); *D10B 2331/02* (2013.01); *D10B 2331/04* (2013.01); *D10B 2401/021* (2013.01); *D10B 2401/022* (2013.01); *D10B 2501/021* (2013.01)

(58) Field of Classification Search
None
See application file for complete search history.

(56) References Cited

U.S. PATENT DOCUMENTS

| | | | | |
|---|---|---|---|---|
| 400,739 A * | 4/1889 | Briggs | D07B 1/02 57/237 |
| 2,077,978 A * | 4/1937 | Anderson | D02G 3/346 66/178 R |
| 2,199,400 A | 5/1940 | Geier et al. | |
| 2,448,782 A | 9/1948 | Davis | |
| 2,777,310 A | 1/1957 | Comer | |
| 2,996,872 A | 8/1961 | Perczynski | |
| 3,419,059 A * | 12/1968 | Bridge, Jr. | B60C 9/0042 152/556 |
| 3,422,873 A * | 1/1969 | Liska | B60C 9/0042 152/556 |

(Continued)

FOREIGN PATENT DOCUMENTS

| | | |
|---|---|---|
| CN | 207269855 U | 4/2018 |
| CN | 213037917 U | 4/2021 |

(Continued)

OTHER PUBLICATIONS

"About Merino Wool." NuMei, Jun. 25, 2015, https://www.numei.com/about-merino-wool.html#:~:text=Merino%20sheep%20produce%20wool%20that,like%20blankets%2C%20insulation%20and%20furnishings. (Year: 2015).*

(Continued)

*Primary Examiner* — Khoa D Huynh
*Assistant Examiner* — Grace Huang
(74) *Attorney, Agent, or Firm* — Wolf, Greenfield & Sacks, P.C.

(57) ABSTRACT

A yarn is produced by twisting an organic yarn and a synthetic yarn. The organic and synthetic yarns and twisting processes thereof may be selected to produce a twisted yarn with enhanced performance characteristics such as moisture management, abrasion resistance, and refit. The twisted yarn may be knitted into articles of clothing such as socks.

20 Claims, 4 Drawing Sheets

(56) References Cited

U.S. PATENT DOCUMENTS

| | | | | |
|---|---|---|---|---|
| 3,470,836 | A * | 10/1969 | New | D02G 3/445 112/410 |
| 4,180,968 | A | 1/1980 | White | |
| 4,571,960 | A * | 2/1986 | Hursh | A41B 11/005 66/196 |
| 5,474,839 | A * | 12/1995 | Ogawa | D06M 15/657 442/167 |
| 5,787,503 | A * | 8/1998 | Murphy, III | A41D 1/04 66/196 |
| 6,952,915 | B2 | 10/2005 | Prickett | |
| 7,127,879 | B2 | 10/2006 | Zhu et al. | |
| 7,520,121 | B2 | 4/2009 | Teshima et al. | |
| 7,690,180 | B2 * | 4/2010 | Hegan, Jr. | D02G 3/46 57/238 |
| 9,974,351 | B2 * | 5/2018 | Heo | A43B 23/0255 |
| 2003/0205041 | A1 * | 11/2003 | Baker, Jr. | D02G 3/36 57/224 |
| 2004/0128973 | A1 * | 7/2004 | Morikawa | D02G 3/32 57/238 |
| 2013/0192311 | A1 * | 8/2013 | Alford | D04B 1/26 66/178 A |
| 2013/0260104 | A1 * | 10/2013 | Dua | B29C 66/133 428/196 |
| 2018/0249766 | A1 | 9/2018 | Stewart | |
| 2019/0194841 | A1 * | 6/2019 | Mittal | A47K 10/02 |
| 2019/0257011 | A1 | 8/2019 | Goenka et al. | |
| 2020/0131675 | A1 | 4/2020 | Bhatnagar et al. | |
| 2020/0291550 | A1 * | 9/2020 | Finck | D02G 3/449 |

FOREIGN PATENT DOCUMENTS

| | | | | |
|---|---|---|---|---|
| DE | 44 03 727 | A1 | 7/1995 | |
| EP | 1 254 978 | B1 | 11/2004 | |
| EP | 1 921 185 | A2 | 5/2008 | |
| EP | 1 921 185 | A3 | 6/2011 | |
| EP | 3399080 | A1 * | 11/2018 | D02G 3/28 |
| FR | 2 205 902 | A5 | 5/1974 | |
| GB | 823 866 | A | 11/1959 | |
| GB | 830 382 | A | 3/1960 | |
| GB | 854 279 | A | 11/1960 | |
| GB | 962 783 | A | 7/1964 | |
| GB | 974 579 | A | 11/1964 | |
| GB | 1 239 331 | A | 7/1971 | |
| GB | 1 331 614 | A | 9/1973 | |
| GB | 1 547 889 | A | 6/1979 | |
| JP | H03-152229 | A | 6/1991 | |
| JP | 05186925 | A * | 7/1993 | D02G 3/26 |
| JP | H08-013271 | A | 1/1996 | |
| JP | 2000-290848 | A | 10/2000 | |
| KR | 2012-0052697 | A | 5/2012 | |
| KR | 2012-0054894 | A | 5/2012 | |
| WO | WO-2020170469 | A1 * | 8/2020 | D02G 3/04 |

OTHER PUBLICATIONS

Tritt, Margit. Yarn Weight Categories . PacaKnits, Jun. 26, 2021, https://www.pacaknits.com/uploads/5/6/3/0/56309397/yarnweightinfo.pdf. (Year: 2021).*

* cited by examiner

TWISTED YARNS AND METHODS OF MANUFACTURE THEREOF

FIELD

Disclosed embodiments are related to twisted yarn, methods for manufacturing the twisted yarn, and knitted articles made from that yarn.

BACKGROUND

Types of yarns include organic yarns, technical yarns, and blended yarns.

SUMMARY

In some embodiments, a twisted yarn comprises an organic yarn comprised of organic staple fibers having a length ranging from approximately 70 mm to 150 mm and a thickness ranging from approximately 16 microns to 28 microns, and a synthetic yarn comprised of synthetic fibers having a length ranging from approximately 28 mm to 132 mm. The organic yarn and the synthetic yarn are twisted together at an angle of approximately 15 to 65 degrees to form the twisted yarn, and wherein the twisted yarn has approximately 10 to 35 twists per inch In some embodiments, a sock comprises a sock body formed by knitting a twisted yarn. The twisted yarn comprises an organic yarn twisted with a synthetic yarn at a twist angle of approximately 15 to 55 degrees and approximately 20 to 35 twists per inch. The organic yarn is comprised of Merino wool staple fibers having a length of ranging from approximately 70 to 150 mm and a thickness ranging from approximately 16 microns to 28 microns. The synthetic yarn is comprised of poly fibers having a length ranging from approximately 28 mm to 132 mm.

In some embodiments, a knitted sock comprises a sock body comprising a first twisted yarn formed by twisting a first organic yarn with a first synthetic yarn. The sock further comprises a second twisted yarn added to at least one region of the sock body less than the entirety of the sock body, the second twisted yarn formed by twisting a second organic yarn with a second synthetic yarn, wherein the first twisted yarn is different from the second twisted yarn.

In some embodiments, a method of forming a twisted yarn comprises twisting an organic thread comprised of organic staple fibers having a length of approximately 70 mm to 150 mm to have approximately 4 to 14 twists per inch. The method further comprises twisting a synthetic thread comprised of synthetic fibers having a length ranging from approximately 28 mm to 132 mm to have approximately 6 to 16 twists per inch. The method further comprises twisting the organic thread and the synthetic thread together at an angle of approximately 15 to 65 degrees to form a twisted yarn, wherein the twisted yarn has approximately 20 to 35 twists per inch and a surface area with approximately a 50:50 ratio of organic staple fibers and synthetic fibers.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
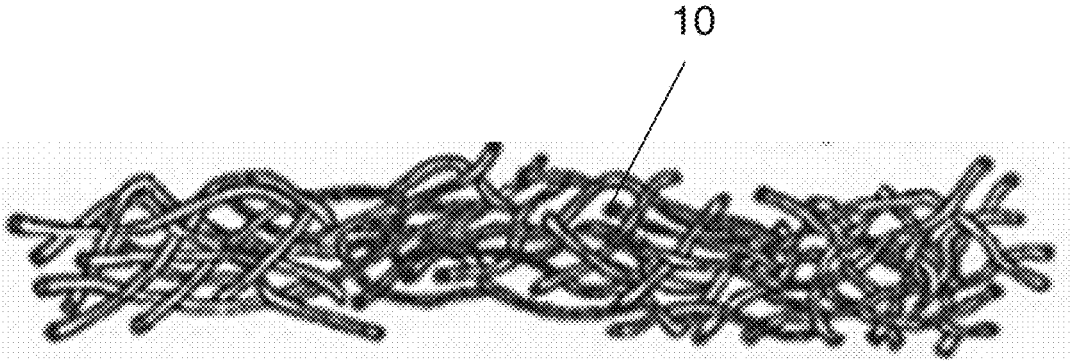
FIG. 1 is a schematic representation of staple fibers, according to one embodiment.

Organic staple yarns are often composed of natural staple fibers of a single organic fiber type (e.g., wool, cotton). The staple fibers may be spun into a continuous strand to form the organic staple yarn. Organic staple yarns are known for having individual attributes of the fiber material. For example, wool is known for moisture wicking and temperature control.

Technical or synthetic yarns are often pulled from a single chemical base to form one long continuous thread called a filament (e.g., nylon, polyester, polypropylene). The filament may be cut into fibers of a desired staple length and the staple fibers may be spun into a continuous strand to form the technical yarn. Technical yarns are known for individual attributes of the specific material base. For example, nylon is known for elasticity and abrasion resistance.

Combination or blended yarns may be formed by combining and spinning staple fibers of more than one material, e.g., organic and/or synthetic fibers. Some blended yarns may combine organic and/or synthetic fibers in an attempt to increase or combine the attributes of both types of fibers. Similar to the manufacture of organic yarns, the fibers may be combined using known methods to create a continuous strand of the blended yarn. However, blended yarns have limitations. For example, during manufacturing, it may be difficult to control the placement of the staple fibers in relation to the final product, resulting in a blended yarn with inconsistent material composition throughout. Accordingly, the blended yarn may have sections with a higher percentage of one material versus another material, creating sections of the yarn that have high or low attributes of a given material. Material that is intended to add softness or wick moisture away from a wearer may not be useful if the material is concentrated within internal sections of the yarn rather than on surface areas of the yarn.

Additionally, combining different types of fibers in a blended yarn may inhibit the desired performance of the individual fibers. For example, mixing wool fibers with other fibers in a blended yarn may limit the wool's natural ability to expand or contract to moderate moisture and/or control temperature.

In view of the above, the inventors have recognized and appreciated a need for a yarn that combines and controls the placement of staple fibers of different materials throughout the yarn to achieve desired physical properties of the yarn.

In some embodiments, a yarn is made by combining at least one organic yarn and at least one synthetic yarn and twisting them together in a specific pattern and style to control the resultant surface area of the twisted yarn (e.g., the ratio of organic and synthetic fibers). The surface area ratio of each yarn may be controlled by adjusting the twist speeds and twist angles when twisting the yarns together. The organic and technical yarns may be chosen based on physical attributes of each yarn, such as moisture management, durability and abrasion resistance, and refit and dimensional stability. Twisted yarns, unlike blended yarns, may produce a yarn with a controlled placement of the different fibers and the surface area ratio to influence the performance characteristics of the resultant twisted yarn. As such, the twisted yarns may have greater tensile strength, dimensional stability, and moisture management properties than blended yarns or yarns made of one material. In this regard, the moisture control, abrasion resistance, and refit of any article formed from the twisted yarns may be tailored by, for example, increasing the surface area of one yarn over another.

Twisting the organic yarn and synthetic yarn together creates a space for air within the twisted yarn, providing several benefits over blended, and thus denser, yarns. The amount of air space within the twisted yarn may be controlled by the number of twists per inch and the twist angle of the yarns. The airspace provides room for the natural expansion of fibers (e.g., wool fibers) during wicking while moderating the fiber's water absorption to prevent oversaturation. This air space increases moisture evaporation from the yarn because more surface area of the yarn is surrounded by air, allowing the moisture to evaporate from the yarn faster. Accordingly, once moisture is wicked from the skin by the organic or technical yarn, the moisture may evaporate more quickly and be less likely to become oversaturated. The added air space within the twisted yarns also creates an insulation effect. Blended yarns do not have any air present within the yarn and thus will have less insulating effect due to the density of the blended yarn.

Twisting organic and synthetic yarns may also increase the refit and dimensional stability of fabrics and garments made with the twisted yarn. For example, fabrics and garments made of wool and other natural fibers may be stretched during normal wear or use. Refit may involve a controlled, limited shrinking of the wool fiber back to its original, pre-wear or pre-use, length during a washing or heating cycle. Wool and natural fibers may exhibit high shrinkage when wetted and dried (e.g., during washing cycles) resulting in a garment that is smaller than the original. To limit the amount of shrinkage, a wool yarn may be paired with a synthetic yarn. For example, by twisting a wool fiber yarn with a synthetic yarn resistant to shrinkage, the synthetic yarn may stabilize the wool yarn by forming a skeleton like frame around the wool fibers (e.g., helix shape), allowing the shrinkage to be controlled to a desired amount back to the original shape and size of the product or garment.

The twisted yarns may be used to form fabrics with desired performance attributes. For example, a twisted yarn may be knitted into articles of clothing such as socks. The location of the sock on a wearer's foot requires moisture management attributes (e.g., wicking, climate control) to keep the wearer's foot dry and the wearer comfortable. It is also desirable for the sock to be soft, durable, and resistant to abrasion at least on parts of the sock exposed to excess wear such as the heel. Additionally, it is desirable for a sock to have good refit attributes to maintain the shape of the sock after repeated wearing and washing. Accordingly, the sock may be designed to include twisted yarns having specific performance characteristics positioned in different portions of the sock depending on need.

The organic and synthetic yarns and twisting processes may be selected to enhance these desired performance characteristics. An organic yarn such as wool, which has high wicking attributes, may be combined with a synthetic yarn, such as nylon, which has high elasticity and refit attributes. The twisting processes used, such as speed, number of twists per inch, and angle of twists, may be altered to control surface area exposure and air entrapment of the twisted yarn to achieve a desired level of performance of attributes of the organic or synthetic yarn.

In some embodiments, a twisted yarn that enhances retention and refit of a sock or other article of clothing may be produced by twisting a single organic yarn with a single synthetic yarn. The synthetic yarn may be subjected to a high temperature to heat set the synthetic yarn and prevent future shrinking of the synthetic yarn under normal wear and wash conditions.

In some embodiments, a twisted yarn that improves moisture management with enhanced wicking or climate control may be produced by twisting an organic yarn with a higher moisture regain with one or more synthetic yarns with multi-lobal cross-sections that have a low to no moisture regain. The combination may allow the organic yarn to absorb moisture while the synthetic may move moisture away from the organic yarn and the wearer's skin. This combination may also allow the organic fibers to flex freely in different temperature settings since they are not blended with the synthetic fibers, which may create more effective insulation and breathability across a range of climates. The twisting may be controlled in include air pockets within the twisted yarn to increase insulation characteristics as well.

In some embodiments, a twisted yarn that increases abrasion resistance may be produced by twisting an organic yarn with high softness characteristics but a lower abrasion resistance with a synthetic yarn that has a higher abrasion resistance to form a resulting twisted yarn that is soft and abrasion resistant.

Figure 2:
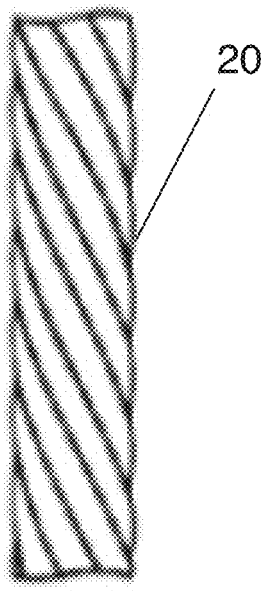
FIG. 2 is a schematic representation of an organic yarn and a technical yarn, according to one embodiment.
Figure 3:
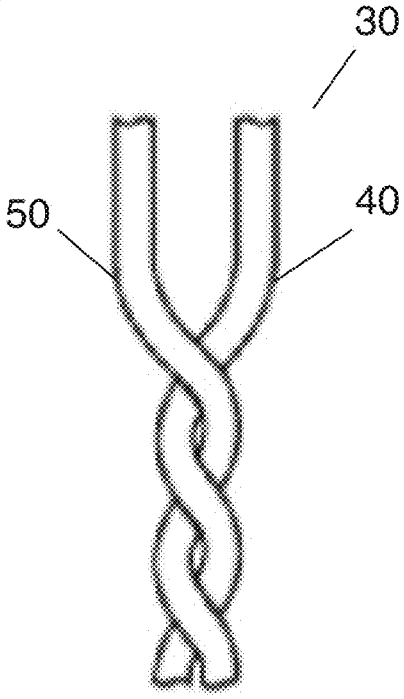
FIG. 3 is a schematic representation of a twisted yarn including an organic yarn and a technical yarn, according to one embodiment.

In some embodiments, a twisted yarn may be produced by twisting an organic yarn with a synthetic yarn. The organic yarn may be made of organic fibers such as wool, cotton, silk, jute, model, etc. The synthetic yarn may be made of synthetic fibers such as nylon, polyester, spandex, etc. Each of the organic and synthetic yarns may be made by spinning staple fibers of a select material (e.g., wool fibers for an organic yarn and nylon fibers for a synthetic yarn) using conventional spinning techniques as known in the art. FIG. 1 shows a plurality of staple fibers 10 that may be spun into a staple fiber yarn 20, shown in FIG. 2. In some embodiments, the organic yarn and the synthetic yarn each may be non-blended yarns composed of one material. In some embodiment, however, the organic yarn and/or the synthetic yarn may include a blend of one or more other organic or synthetic materials, as the disclosure is not so limited. As shown in FIG. 3, a twisted yarn 30 may be formed by twisting an organic yarn 40 with a synthetic yarn 50.

In some embodiments, an organic yarn may be made from Merino wool staple fibers. The Merino wool staple fiber has a length that is relatively longer than typical organic staple fibers, which may allow for a stronger, finer yarn. The longer staple fiber length may also lead to increased durability of the organic wool yarn while creating a softer hand feel.

Additionally, the Merino wool staple fiber, when incorporated into a sock or other article of clothing, may be able to moderate the microclimate of the wearer. The Merino wool staple fiber has a helix shape and scaley structure. The helix shape gives the Merino staple fiber a natural bulkiness, which, along with its scaley structure, may trap air within the fiber, thereby creating an insulating effect. As the staple fiber is stretched and relaxed during wear, the air may be trapped and released, providing the wearer to with an increased level of microclimate moderation. The scaley structure can also trap moisture, allowing the Merino wool fiber to have a moisture regain of up to approximately 40% in 100% relative humidity. However, once the Merino wool fiber is sufficiently or fully saturated, it may not be able to dry quickly.

Twisting an organic yarn made of Merino wool staple fibers with a synthetic yarn may enhance the Merino wool fibers' ability to move moisture away from the wearer's skin, thereby keeping the wearer dryer. Twisting the organic and synthetic yarns together allows for a greater surface area of each yarn type to be against the wearer's skin, while also maintaining contact with each other. The multi-lobal and/or multi-channel structure of the synthetic yarn may allow for natural capillary action which may wick moisture away from the wearer's skin and away from the Merino wool yarn when the yarns become sufficiently saturated with moisture. The synthetic yarn may act to slow the moisture saturation of the Merino wool fibers, which lose their wicking capabilities if they become oversaturated, by preventing the Merino fibers from overexpanding. The expansion and contraction of the merino fibers are not disturbed by the method, angle or tightness of twists of the synthetic yarn, allowing the Merino fibers to perform as designed. The synthetic yarn may also help to draw the moisture away from the Merino fibers. For example, the twisted yarn may more effectively pull moisture away the surface of the foot, such as in a spiral direction along the twist, and push the moisture to an exterior surface for faster drying. Accordingly, the organic Merino wool yarn may dry at a faster rate when twisted with a synthetic yarn than the Merino wool yarn alone.

Moreover, synthetic fibers may have a relatively higher tensile strength than the Merino wool staple fibers. By twisting a yarn made of synthetic fibers (e.g., nylon, polyester, polypropylene, etc.) together with an organic yarn, the synthetic fibers may provide a barrier against abrasive contact. As a non-limiting example, a sock knitted with the twisted yarn may experience wear and tear between a wearer's shoe and heel. The synthetic yarn of the twisted yarn may aid in resisting abrasion during wear of the sock. Furthermore, the final product (e.g., sock) may be heat set, and as such the synthetic yarn (whether blended or 100% synthetic) may create a supporting cage to create dimensional stability within the product.

In some embodiments, an organic yarn may be made from organic staple fibers. In some embodiments, the organic staple fibers may have a thickness of between approximately 12 microns to approximately 28 microns. In some embodiments, the cotton staple fibers may have a thickness of approximately 12 microns to approximately 20 microns and the Merino wool fibers may have a thickness of approximately 16 microns to approximately 28 microns.

In some embodiments, an organic Merino wool yarn may be made of Merino staple fibers that have a length of approximately 50 mm to approximately 150 mm. Prior to forming the organic yarn, the Merino wool staple fibers may undergo a combing mechanism to align the fibers and/or cause shorter staple fiber lengths to drop out. The merino wool staple fibers may be spun into a single content yarn (e.g., 1 ply, 100% merino) of a size ranging from approximately 1/44NM to approximately 1/54 NM, or any suitable linear density. The organic yarn may be spun using known spinning techniques in the art (e.g., via ring spinning). In some embodiments, the organic yarn may be 1 ply, 2 ply, or 3 ply. In some embodiments the organic yarn may be 100% Merino wool, but the disclosure is not so limited, and organic yarns and/or organic blends with additional materials, organic and/or synthetic, may be utilized depending on specific need and desired outcome. Other organic staple fibers that may be used include, but are not limited to cotton, jute, silk, model, etc.

In some embodiments, a synthetic yarn may be made from nylon or polyester staple fibers. In some embodiments, the synthetic fibers may have a length of approximately 25 mm to approximately 132 mm. In some embodiments, the synthetic staple fibers may have a length of approximately 28 mm to approximately 64 mm. The cross section of the synthetic fibers may be multi-lobal and/or channeled with greater than four (4) lobes and/or four (4) channels. The synthetic fibers are typically spun into a single content yarn (1 ply, 100% synthetic) of a size ranging from approximately 32 denier to approximately 70 denier, or any suitable linear density. In some embodiments, the synthetic yarn may be 1 ply, 2 ply, or 3 ply. In some embodiments the synthetic yarn may be made of just one fiber material, but the disclosure is not so limited, and synthetic yarns and/or synthetic blends with additional materials, organic and/or synthetic, may be utilized depending on specific need and desired outcome. Other synthetic staple fibers that may be used include, but are not limited to polyester, etc.

In some embodiments, the twisted yarn may be formed by twisting an organic yarn and a synthetic yarn. Each of the organic yarn and synthetic yarns may be 1 ply, 2 ply, 3 ply, or more, depending on desired physical properties. Yarns with higher ply may have higher airspace in the yarn with may increase insulation. Accordingly, changing the ply of the yarn may alter the moisture management or insulation characteristics of the yarn. In addition, reducing the ply of a yarn may reduce the size of the yarn so that the yarn may fit into a smaller gauge sized machine used for knitting the yarn into a garment.

In some embodiments, the single ply yarn combinations may have approximately 5 twists to approximately 7 twists per inch. In some embodiments, the two-ply and three-ply yarns may have approximately 4 twists to approximately 14 twists per inch. The single ply yarns may be twisted in either S or Z direction. The multi-ply yarns may be formed by twisting one or more single ply yarns together in the opposite direction to create a natural twist in the multi-ply yarn.

In some embodiments, an organic yarn and a synthetic yarn may be twisted together at a twist angle of approximately 70 degree to approximately 90 degrees. This may allow the twisted yarn to have a symmetrical surface area of exposed organic and synthetic yarns and optimize the amount of each surface area that may be exposed to a wearer's skin when the twisted yarn is incorporated into a final product (e.g., sock).

In some embodiments, the twisted yarn may include an elastane filament yarn that has high elongation and recovery performance characteristics. As such, the finished product (e.g., sock) made of the twisted yarn may have increased re-fit characteristics due to the addition of the elastane filament yarn. Additionally, the elasticity of the elastane filament may protect the finished product against stretching or breakdown that can occur from use and/or machine washing. In some embodiments, the elastane filament yarn may include a synthetic yarn (e.g., nylon or polyester) in sizes of approximately 3070FTY (Fully Texture Yarn) spandex/nylon, 1207070FTY elastane/nylon, or 1807070FTY elastane/nylon. The elastane filament yarn may be twisted with a Merino wool yarn, forming a twisted yarn. In some embodiments, the twisted yarn may contain a minimum of approximately thirty percent (30%) Merino wool. In some embodiments, the twisted yarn may contain more than or equal to approximately 15% Merino wool. In some embodiments, the twisted yarn may contain less than or equal to approximately 85% Merino wool.

The twisted yarn of the individual organic and synthetic yarns may be used in many applications. In some embodiments, the twisted yarn may be knitted into articles of clothing. As such, the gauge size of a knitting machine may factor into the total number of plied yarns that may be used. Knitting machines for socks may utilize needle counts of 84N, 108N, 132N, 144N, or 200N. In some embodiments, the stitch types within a fabric may include 1×1, 2×1, 3×1 rib, single jersey, and customized jacquard patterns. The resultant fabric structure made from the twisted yarn may be heat set using an oven at a minimum temperature of 110 degrees Fahrenheit. Thermosetting the synthetic yarns may support the re-fit and dimensional stability of the finished product.

EXAMPLES

Below are provided examples of twisted yarns and socks manufactured using the twisted yarns. It should be noted that the twisted yarns are described as being formed by twisting one or more threads together. It should be noted that the threads may also be referred to as yarns.

In a first embodiment, a first twisted yarn having increased moisture management and refit performance characteristics is created using a first thread of 100% Merino fibers and a second thread of 100% spun poly. The Merino thread may have a size of approximately 1/54 NM and may be made from staple fibers having a length of approximately 70 mm to 150 mm and a thickness of approximately 16 microns to approximately 28 microns. The Merino thread may be twisted in an S direction (e.g., counterclockwise) to have approximately 4 to 14 twists per inch. In some embodiments, the organic thread may be treated with a hydrophobic treatment to decrease the absorption rate of moisture by the organic thread.

The spun poly thread may have a size of approximately 1/32 NM and may be made from staple fibers having a length of approximately 40 mm. The spun poly may be twisted in an S direction (e.g., counterclockwise) to have approximately 6 to 16 twists per inch. In some embodiments, the spun poly thread may be treated to be hydrophilic to have increased wicking characteristics.

The Merino thread and spun poly thread are then twisted together in a Z direction (e.g., clockwise) at a twist angle of approximately 15 to 65 degrees to have approximately 20 to 35 twists per inch to create the first twisted yarn. The first twisted yarn may have approximately a 50:50 ratio of Merino and spun poly surface area. The first twisted yarn may have increased moisture management and refit characteristics. For example, the shorter, less stretchable fibers of the spun poly provide dimensional stability for the Merino fibers when exposed to heat or agitation. In addition, the twist angle and twists per inch may be balanced to improve moisture wicking. The twist may be sufficiently loose to allow for the natural expansion and contraction of the Merino staple fibers to absorb and release moisture, while also being sufficiently tight such that the poly fibers prevent the Merino fibers from expanding too much and becoming overburdened with moisture, which decreases the Merino fibers natural wicking and moisture release action.

Figure 4:
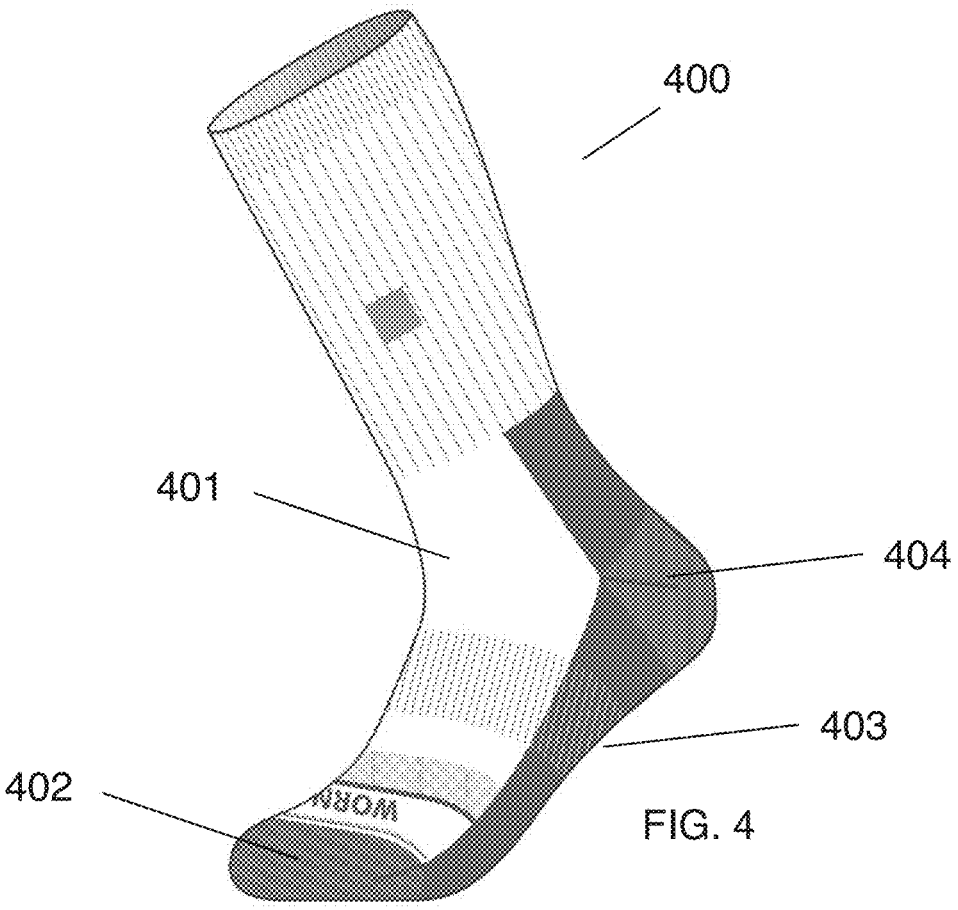
FIG. 4 is a schematic perspective view of a sock, according to one embodiment.

The first twisted yarn may be loaded into a 144N-200N machine or similar for knitting and may be used to manufacture a sock 400, as shown in FIG. 4. The first twisted yarn may be knitted to form the full sock body 401 of sock 400. In some embodiments, portions of the sock 400 may include exterior plated reinforcement by adding a second yarn to the sock. In a non-limiting example, the toes section 402, bottom section 403, and heel section 404 of the sock 400 shown may include exterior plated reinforcement (e.g., shown in grey in sock 400 of FIG. 4). In some embodiments, a sock formed of the first twisted yarn may include enhanced moisture management and refit characteristics. As non-limiting examples, the sock is a versatile sock that may be worn by a wearer for everyday use in everyday shoes and boots, in moderate temperatures ranging from 45 to 85 degrees F., and/or in casual, home, or office use.

In a second embodiment, a second twisted yarn having increased moisture management and climate moderation is made by twisting a 100% Merino fiber thread, and two 100% poly threads. The Merino thread may have a size of approximately 1/16 to 1/32 NM and may be made from staple fibers having a length of approximately 70 to 150 mm. The Merino thread may be twisted in an S direction (e.g., counterclockwise) to have approximately 4 to 14 twists per inch. Each of the poly threads may have a size of approximately 1/32 NM and may be made from staple fibers having a length of approximately 40 mm. The poly threads may each be twisted in an S direction (e.g., counterclockwise) to have approximately 6 to 16 twists per inch. The poly threads may be treated to be hydrophilic to have increased wicking characteristics.

The Merino thread and the two poly threads are then twisted together in a Z direction (e.g., clockwise) at a twist angle of approximately 25 to 55 degrees to have approximately 12 to 20 twists per inch to create the second twisted yarn. The second twisted yarn may have a 70:30 ratio of poly versus wool surface area. This ratio may increase the wicking surface of the yarn and protect the Merino fiber from becoming over saturated with moisture. For example, the twisted yarn may allow the wool fibers in the wool yarn to expand without separating from the poly fibers of the poly yarn, resulting in a yarn with increased wicking characteristics.

Figure 5:
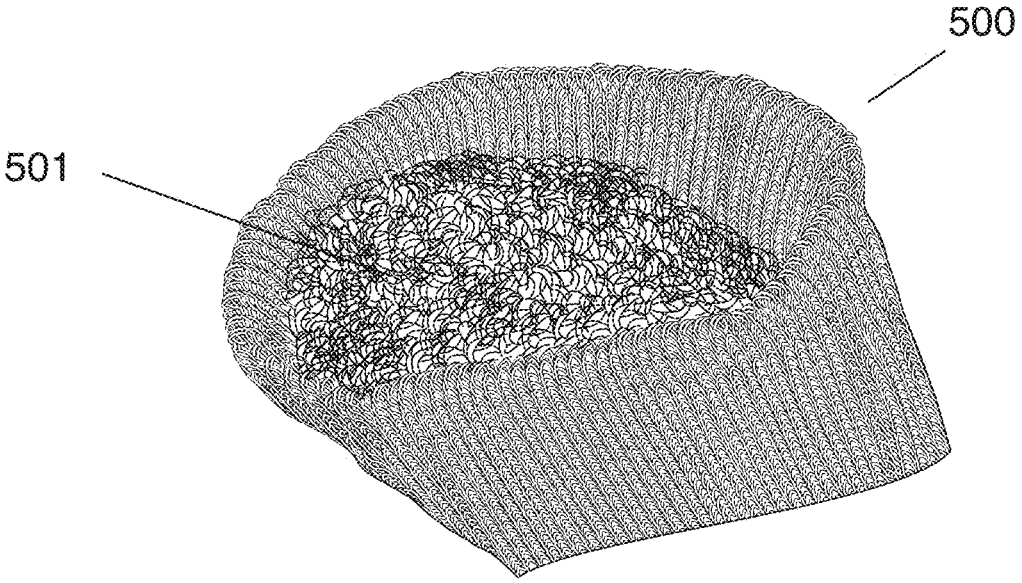
FIG. 5 is a picture of an interior portion of a sock, according to one embodiment.

The second twisted yarn may be loaded into a 108N-168N machine or similar for knitting. As a non-limited example, the twisted yarn may be placed in an interior portion of a sock as interior terry loops to provide cushioning against the wearer's foot as well as increased wicking. FIG. 5 shows an example of a sock 500 with interior terry loops 501 that may be formed of the twisted yarn described herein. In some embodiments, an exterior of sock 500 may be knit with nylon or acrylic yarn for abrasion protection. In a non-limiting example, the second twisted yarn may be used in heavier working conditions during which a user may be likely to sweat, such as construction boots or footwear worn during farming, yard, and/or house work.

In a third embodiment, a third twisted yarn having increased insulating and moisture management characteristics (e.g., breathability) is made using two 100% Merino fiber threads and a 100% poly thread. The two Merino threads may each have a size of approximately 1/16 to 1/54 NM and may be made from staple fibers having a length of approximately 70 to 150 mm a thickness of approximately 16 microns to approximately 28 microns. The Merino fiber threads may be twisted in an S direction (e.g., counterclockwise) to have approximately 4 to 14 twists per inch. The spun poly thread may have a size of approximately 1/32 NM and may be made from staple fibers having a length of approximately 40 mm. The poly thread may be twisted in an S direction (e.g., counterclockwise) to have approximately 6 to 16 twists per inch. The spun poly thread may be treated to be hydrophilic to have increased wicking characteristics.

The two Merino threads and spun poly thread are then twisted together in a Z direction (e.g., clockwise) at a twist angle of approximately 35 to 75 degrees to have approximately 8 to 16 twists per inch to form the third twisted yarn, allowing for increased Merino fiber expansion and insulation abilities. The third twisted yarn may have a 70:30 ratio of Merino verses poly surface area. The third twisted yarn may have enhanced insulation and breathability characteristics.

Figure 6:
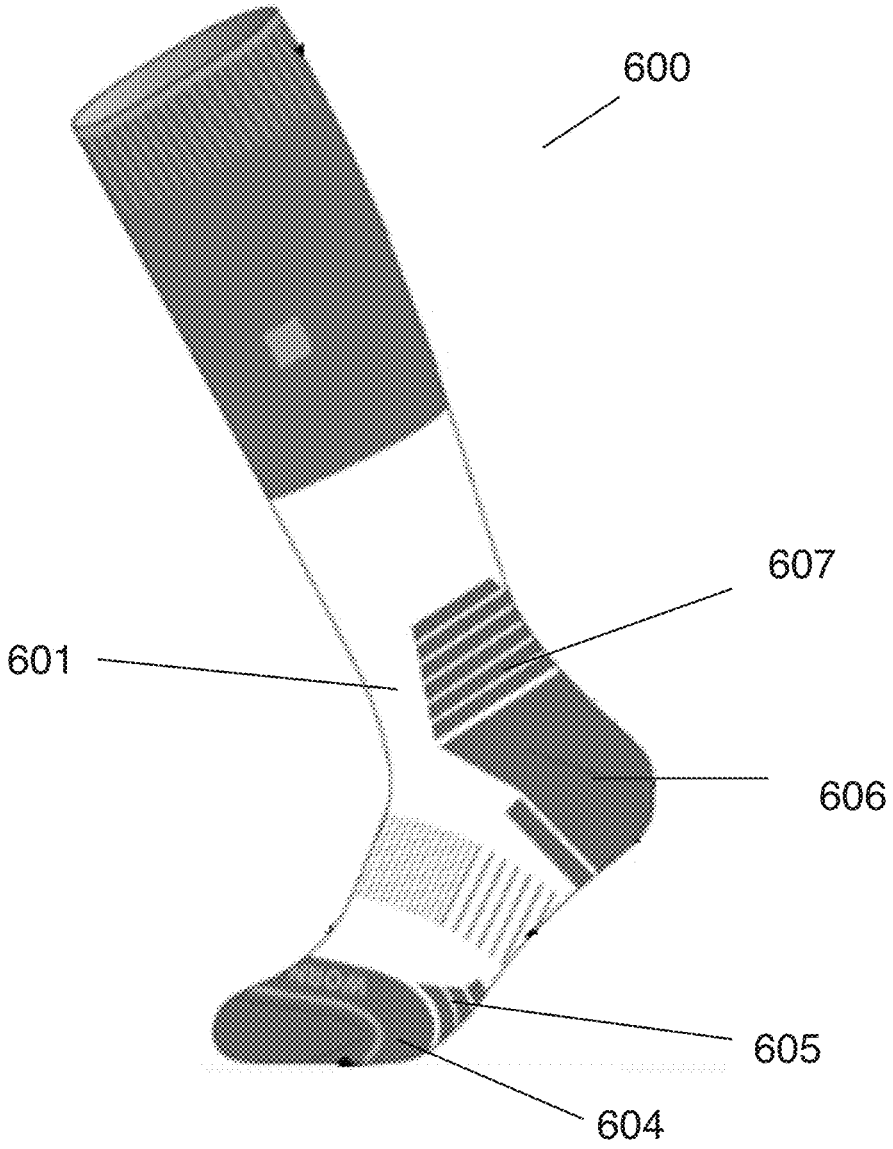
FIG. 6 is a schematic of a sock, according to one embodiment.

The third twisted yarn may be loaded into a 108N-168N machine or similar for knitting. In some embodiments, the twisted yarn may be included in a sock 600 as shown in FIG. 6. The sock 600 may include enhanced insulation and breathability, making the sock ideal for colder climates. In a non-limiting example, the sock 600 may be a ski or snowboarding sock capable of keeping a wearer's foot warm and dry in cold climates even when the wearer sweats. In some embodiments, the full sock body 601 of sock 600, which touches the wearer's skin, may be made of the third twisted yarn. In some embodiments, the full sock body 601 of sock 600, which touches the wearer's skin, may be made of the first twisted yarn described above. The sock 600 may include interior terry loops (not shown) made of the third twisted yarn to provide cushioning and added insulation and moisture management against the wearer's foot.

In a fourth embodiment, a fourth twisted yarn having increased abrasion resistance and moisture management is made using a 100% Merino wool thread and a nylon thread. The Merino thread may have a size of approximately 1/16 to 1/54 NM and may be made from staple fibers having a length of approximately 70 to 150 mm a thickness of approximately 16 microns to approximately 28 microns. The Merino thread may be twisted in an S direction (e.g., counterclockwise) to have approximately 4 to 14 twists per inch. The nylon thread may have a size of approximately 40 denier and may be made from staple fibers having a length of approximately 40 to 100 mm. The nylon thread may be twisted in an S direction (e.g., counterclockwise) to have approximately 6 to 16 twists per inch. The nylon thread may be treated to be hydrophilic to have increased wicking characteristics.

The Merino thread and the nylon thread are then twisted together in a Z direction (e.g., clockwise) at a twist angle of approximately 15 to 45 degrees to have approximately 10 to 35 twists per inch to form the fourth twisted yarn. The fourth twisted yarn may have a 55:45 ratio, approximately, of nylon verses Merino surface area. The fourth twisted yarn may have enhanced abrasion resistance and moisture management characteristics. The twisting of the threads provides airspace within the twisted yarn, allowing for the natural expansion and contraction of the Merino fibers to continue natural climate moderation and moisture management activities, without being restricted.

Figure 7A:
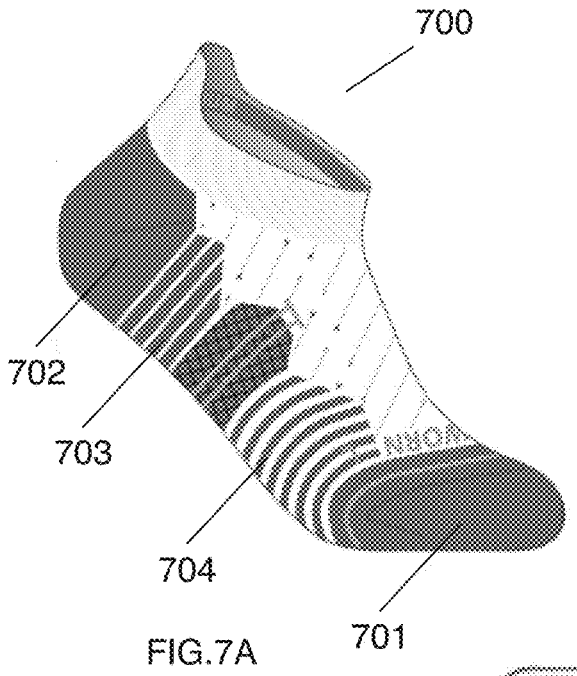
FIGS. 7A-7C are schematic interior, exterior, and bottom views of a left sock, respectively, according to one embodiment.
Figure 7B:
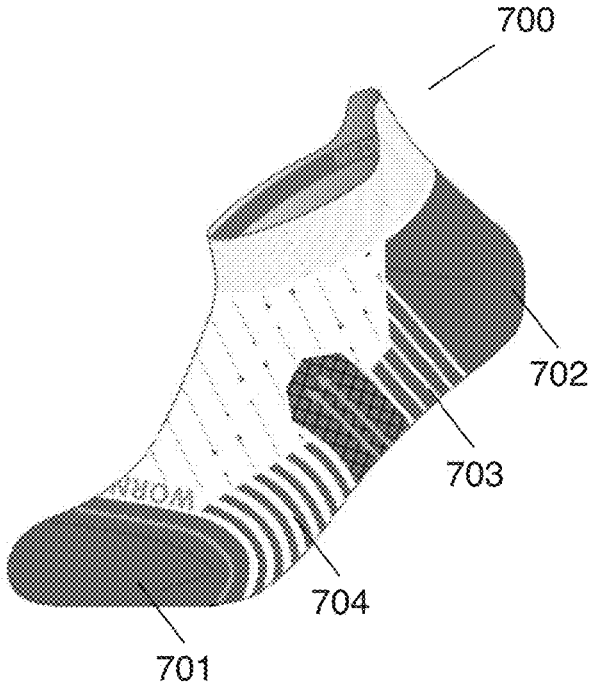
Figure 7C:
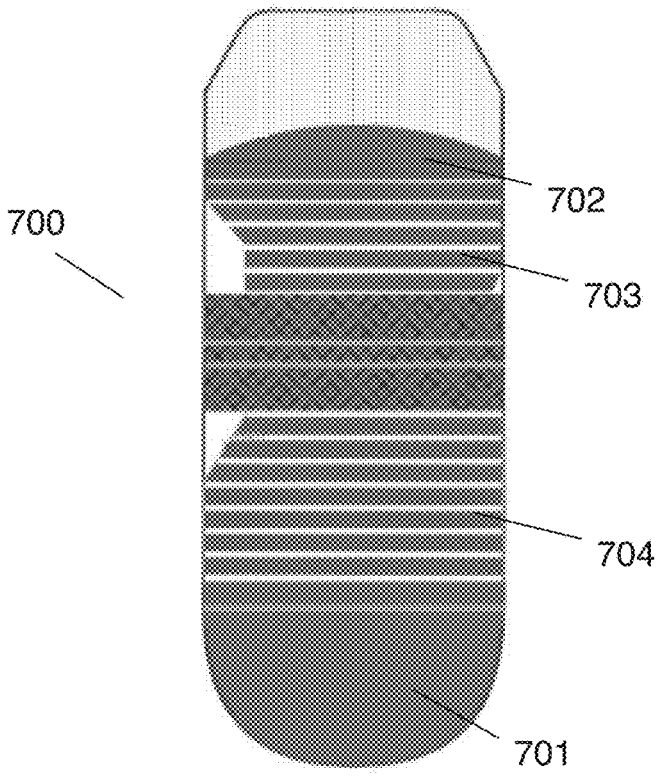

The fourth twisted yarn may be loaded into a 108N-200N machine or similar for knitting. In some embodiments, the fourth twisted yarn may be added to a sock as interior terry loops. FIGS. 7A-7C show schematics of an exterior, interior, and bottom view of a left sock 700, respectively. The fourth twisted yarn may be placed in the sock 700 as interior terry loops (not shown) in the toe portion 701, heel portion 702, and within grey stripes along the bottom portions 703, 704 of the sock 700. The interior terry loops may provide added cushioning as well as increased abrasion resistance and moisture management. The interior terry loops may provide protection against increased wear in high stress portions of the sock, such as the toe portion 701 and heel portion 702. The terry loops may also provide increased moisture management in high sweat zones of the sock, such as on the bottom portions 703, 704 of the wearer's foot. In some embodiments, terry loops may be added using the fourth twisted yarn to provide targeting cushioning in athletic socks.

In some embodiments, as shown in FIG. 6, the fourth twisted yarn may form portions of sock 600. In some embodiments, a toe portion 604 and heel portion 606 may be knit of the fourth twisted yarn to provide increased abrasion resistance in these areas. Other areas of the sock, such as bottom portion 605 and upper heel portion 607 may also be knit or include terry loops (see grey stripes) of the fourth twisted yarn to provide cushioning and increased abrasion resistance and moisture control in these areas.

In a fifth embodiment, a fifth twisted yarn having increased breathability and abrasion resistance is made using three 100% Merino wool threads and 2 nylon threads. Each of the Merino threads may have a size of approximately 3/54 NM. One of the Merino threads may be made from staple fibers having a length of approximately 70 to 150 mm and two of the Merino threads may be made from staple fibers having a length of approximately 40 mm to 100 mm. Each Merino thread is individually twisted in an S direction to have 4 to 14 twists per inch. The three Merino threads are then twisted together in an S direction at approximately 40 to 80 degrees to have approximately 6 to 12 twists per inch to form a 3-ply Merino yarn.

The two nylon threads may have a size of approximately to 70 denier and may be made from staple fibers having a length of approximately 40 to 100 mm. Two nylon threads are twisted individually in an S direction to have 6 to 16 twists per inch. The two nylon threads are then twisted together in an S direction at approximately 45 to 75 degrees to have approximately 8 to 14 twists per inch to form a 2-ply nylon yarn. The nylon yarn may be treated to be hydrophilic to have increased wicking characteristics.

The 3-ply Merino yarn and the 2-ply nylon yarn are then twisted together in a Z direction (e.g., clockwise) at a twist angle of approximately 10 to 60 degrees to have approximately 10 to 35 twists per inch to form the fifth twisted yarn. The fifth twisted yarn may have a surface area of approximately 60% or more Merino to increase the yarn's insulation capabilities (e.g., expansion for warmth). The surrounding nylon may protect the Merino fibers from over saturation of moisture and increase refit and dimensional stability. The fifth twisted yarn may be added to a full sock body as interior terry loops in portions of the sock, such as in any of the socks described herein, for example, to provide extra cushioning against a wearer's foot. In some embodiments, the fifth twisted yarn may be included in athletic socks, such a rugby sock, athletic sock, or worn with work boots, snow boots, or ski or snowboard boots.

The twisted yarns, included those described above, may have enhanced physical properties over blended or singular yarns. As described above, twisting the threads provides airspace within the twisted yarn to allow for a symbiotic effect, increasing the physical qualities of each of the threads. For example, the airspace in the twisted yarn allows for the natural expansion and contraction of the Merino fibers while also providing stability and added wicking properties from the technical fibers.

Testing Results

Shape Retention Test: Shape retentions tests were conducted to measure the dimensional stability and refit characteristics of various knitted socks. Four styles of socks were tested: socks knitted with the first twisted yarn described herein, socks knitted with the fourth twisted yarn described herein, socks knitted using 100% Merino wool, and socks knitted with 100% cotton. Six samples of 100% Merino socks and ten samples of each remaining sock type were tested.

Testing methods included subjecting the socks to 50 wash and dry cycles using a home washing machine and drier on standard wash settings. The length and width of each sock was measured to determine the dimensional shape of the sock before and after the wash and dry cycles using hand measurements. The final dimensional shape of the shocks were compared to the initial dimensional shape to determine the amount of shape reduction (e.g., shrinkage) after 50 wash cycles.

Results show that socks knitted with the first twisted yarn and the socks knitted with the fourth twisted yarn showed minimal shape reduction, with less than a 5% shape reduction. The 100% cotton socks showed moderate shape reduction, with approximately 15-20% shape reduction. The 100% Merino socks showed moderate shape reduction, with approximately 15-20% shape reduction.

Wear Test: Wear tests were conducted to determine how wells various knitted socks resisted wear and tear (e.g., developing holes in the sock, breakage in thread, and/or pilling). Four different socks were tested: socks knitted with the first twisted yarn described herein, socks knitted with the fourth twisted yarn described herein, socks knitted using 100% Merino wool, and socks knitted with 100% cotton. Six samples of 100% Merino socks and ten samples of each remaining sock type were tested.

Results show that knitted with the first twisted yarn and the socks knitted with the fourth twisted yarn had zero incidents of wear through the sock and exhibited only light surface pilling. In the 100% cotton socks, 60% of samples tested had marked issues, the first 30% with complete failure (e.g., wear through via formation of holes), and the second 30% with noticeable separation and multiple snags or breaks in the thread material. The 100% Merino socks showed zero incidents of wear through the sock but exhibited heavy pilling.

Dry Time Test: Fabrics measuring 2 inches by 3 inches knitted with various yarns were testing to measure their drying time. Four samples of fabrics made of the first twisted yarn, the fourth twisted yarn, 100% cotton yarn, and 100% Merino yarn were tested. Testing methods included submerging the fabric samples in water for 15 seconds and subsequently setting the wet fabric samples on a lightly heated plate to dry until no moisture was present on the fabric surface and the fabric was dry to touch.

Results: The fabric samples made of the first twisted yarn did not feel saturated to touch after submerging in water for 15 seconds. The average drying time was approximately 18 seconds. The fabric samples made of the fourth twisted yarn also did not feel saturated to touch after submerging in water for 15 seconds. The average drying time was approximately 15 seconds. The 100% cotton fabric samples were fully saturated after submerging in water for 15 seconds. The average dry times was approximately 1 minute and 20 seconds. The 100% Merino fabric samples did not feel full saturated to touch after submerging in water for 15 seconds but retained moisture. The average dry times was approximately 40 seconds.

In view of the testing results described above, socks and fabrics made of the first and fourth twisted yarns exhibited superior shape retention, wear, and drying characteristics compared to socks and fabrics made of 100% cotton and 100% Merino wool yarns.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

The invention claimed is:

1. A sock comprising:

a sock body formed by knitting a twisted yarn, the twisted yarn comprising:

an organic yarn twisted with a synthetic yarn at a twist angle of approximately 15 to 55 degrees and approximately 20 to 35 twists per inch, wherein the organic yarn comprises a first organic thread comprised of Merino wool staple fibers having a length of ranging from approximately 70 to 150 mm and a thickness ranging from approximately 16 microns to 28 microns, and the synthetic yarn comprises a first synthetic thread comprised of poly fibers having a length ranging from approximately 28 mm to 132 mm, and wherein the twisted yarn has a surface area with approximately a 50:50 ratio of Merino wool fibers and poly fibers.

2. The sock of claim 1, wherein the synthetic yarn has a size of 1/32 NM.

3. The sock of claim 1, wherein the organic yarn is twisted in a first direction and includes 4 to 14 twists per inch and the synthetic yarn is twisted in the first direction and includes 4 to 14 twists per inch.

4. The sock of claim 3, wherein the organic yarn and the synthetic yarn are twisted together in a second direction opposite the first direction.

5. The sock of claim 1, wherein the organic yarn comprises a second organic thread.

6. The sock of claim 1, wherein the synthetic yarn comprises a second synthetic thread.

7. The sock of claim 1, wherein the synthetic yarn includes a hydrophilic treatment.

8. The sock of claim 1, wherein the organic yarn includes a hydrophobic treatment.

9. The sock of claim 1, wherein the organic yarn is comprised solely of Merino wool fibers.

10. A knitted sock comprising:

a sock body comprising a first twisted yarn formed by twisting a first organic yarn with a first synthetic yarn; and a second twisted yarn added to at least one region of the sock body less than the entirety of the sock body, the second twisted yarn formed by twisting a second organic yarn with a second synthetic yarn, wherein the first twisted yarn is different from the second twisted yarn and, wherein the at least one region of the sock body includes the first and second twisted yarns, wherein the first organic yarn is comprised of Merino wool staple fibers having a length ranging from approximately 70 to 150 mm and a thickness ranging from approximately 16 microns to 28 microns, and wherein the first twisted yarn has a surface area with approximately a 50:50 ratio of the Merino wool staple fibers and poly fibers.

11. The knitted sock of claim 10, wherein the first synthetic yarn is comprised of the poly fibers having a length ranging approximately 28 mm to 132 mm.

12. The knitted sock of claim 10, wherein the second twisted yarn is added to a toe region and a heel region of the sock body.

13. The knitted sock of claim 10, wherein the second twisted yarn forms loops on an interior surface of the sock body.

14. The knitted sock of claim 10, wherein the second twisted yarn is added to an exterior surface and an interior surface of the sock body.

15. The knitted sock of claim 10, wherein an entire surface of the sock body is made of the first twisted yarn.

16. A knitted sock comprising:

a sock body comprising a first twisted yarn formed by twisting a first organic yarn with a first synthetic yarn; and a second twisted yarn added to at least one region of the sock body less than the entirety of the sock body, the second twisted yarn formed by twisting a second organic yarn with a second synthetic yarn, wherein the first twisted yarn is different from the second twisted yarn and, wherein the at least one region of the sock body includes the first and second twisted yarns, wherein the first twisted yarn is formed by twisting the first organic yarn and the first synthetic yarn at a twist angle of approximately 15 to 55 degrees and approximately 20 to 35 twists per inch, and wherein the first twisted yarn has a surface area with approximately a 50:50 ratio of Merino wool fibers and poly fibers.

17. A knitted sock comprising:

a sock body comprising a first twisted yarn formed by twisting a first organic yarn with a first synthetic yarn; and a second twisted yarn added to at least one region of the sock body less than the entirety of the sock body, the second twisted yarn formed by twisting a second organic yarn with a second synthetic yarn, wherein the first twisted yarn is different from the second twisted yarn and, wherein the at least one region of the sock body includes the first and second twisted yarns, wherein the second organic yarn comprises a Merino thread having a size ranging from 1/16 NM to 1/32 NM and comprised of Merino wool staple fibers having a length of ranging from approximately 70 to 150 mm, and wherein the first twisted yarn has a surface area with approximately a 50:50 ratio of Merino wool staple fibers and poly fibers.

18. A knitted sock comprising:

a sock body comprising a first twisted yarn formed by twisting a first organic yarn with a first synthetic yarn; and a second twisted yarn added to at least one region of the sock body less than the entirety of the sock body, the second twisted yarn formed by twisting a second organic yarn with a second synthetic yarn, wherein the first twisted yarn is different from the second twisted yarn and, wherein the at least one region of the sock body includes the first and second twisted yarns, wherein the second synthetic yarn comprises at least two poly threads each having a size of 1/32 NM and comprised of poly fibers having a length of approximately 40 mm, and wherein the first twisted yarn has a surface area with approximately a 50:50 ratio of Merino wool staple fibers and poly fibers.

19. A knitted sock comprising:

a sock body comprising a first twisted yarn formed by twisting a first organic yarn with a first synthetic yarn; and a second twisted yarn added to at least one region of the sock body less than the entirety of the sock body, the second twisted yarn formed by twisting a second organic yarn with a second synthetic yarn, wherein the first twisted yarn is different from the second twisted yarn and, wherein the at least one region of the sock body includes the first and second twisted yarns, wherein the second twisted yarn is formed by twisting the second organic yarn and the second synthetic yarn at a twist angle of approximately 25 to 55 degrees and approximately 12 to 20 twists per inch, wherein the first twisted yarn has a surface area with approximately a 50:50 ratio of Merino wool staple fibers and poly fibers.

20. A sock comprising:

a sock body formed by knitting a twisted yarn, the twisted yarn comprising:

an organic yarn twisted with a synthetic yarn at a twist angle of approximately 15 to 55 degrees and approximately 20 to 35 twists per inch, wherein the organic yarn comprises a first organic thread comprised of Merino wool staple fibers having a length of ranging from approximately 70 to 150 mm and a thickness ranging from approximately 16 microns to 28 microns, and wherein the organic yarn is comprised solely of Merino wool fibers, and the synthetic yarn comprises a first synthetic thread comprised of poly fibers having a length ranging from approximately 28 mm to 132 mm, and wherein the twisted yarn has a surface area with approximately a 50:50 ratio of Merino wool fibers and poly fibers, and wherein the organic yarn and the synthetic yarn each include the same number of twists per inch before being twisted together.

* * * * *